US006931806B2

(12) United States Patent
Olsen

(10) Patent No.: US 6,931,806 B2
(45) Date of Patent: Aug. 23, 2005

(54) CONCRETE FORMING SYSTEM AND METHOD

(76) Inventor: Timothy A. Olsen, 18635 W. Hardison Rd., Post Falls, ID (US) 83854

( * ) Notice: Subject to any disclaimer, the term of this patent is extended or adjusted under 35 U.S.C. 154(b) by 100 days.

(21) Appl. No.: 10/412,668

(22) Filed: Apr. 14, 2003

(65) Prior Publication Data

US 2004/0200176 A1 Oct. 14, 2004

(51) Int. Cl.[7] ..... E04B 2/00; E04B 2/40; E04G 17/04; E04G 17/06

(52) U.S. Cl. ..... 52/309.11; 52/426; 52/677; 52/565; 52/699; 52/742.14; 52/250; 249/40; 249/216

(58) Field of Search ..... 52/309.11, 426, 52/677, 565, 699, 742.14, 250; 249/40, 216

(56) References Cited

U.S. PATENT DOCUMENTS

| | | | | | |
|---|---|---|---|---|---|
| 878,000 | A | * | 2/1908 | Holman | 249/37 |
| 1,227,041 | A | * | 5/1917 | Colt | 249/40 |
| 1,437,323 | A | * | 11/1922 | McClure | 249/216 |
| 1,616,977 | A | * | 2/1927 | Koivu | 52/426 |
| 1,762,099 | A | * | 6/1930 | Phillips | 52/564 |
| 1,924,724 | A | * | 8/1933 | Olney | 52/379 |
| 2,099,260 | A | * | 11/1937 | Colt | 249/43 |
| 2,546,043 | A | * | 3/1951 | Parmenter | 403/171 |
| 3,728,836 | A | * | 4/1973 | Gates | 52/687 |
| 4,116,514 | A | * | 9/1978 | Lawrence | 439/31 |
| 4,229,920 | A | * | 10/1980 | Lount | 52/309.12 |
| 4,234,156 | A | * | 11/1980 | Wepf | 249/40 |
| D293,876 | S | * | 1/1988 | Thomson | D8/328 |
| 4,765,109 | A | * | 8/1988 | Boeshart | 52/426 |
| 4,866,891 | A | | 9/1989 | Young | |
| 4,888,931 | A | | 12/1989 | Meilleur | |
| 4,916,879 | A | * | 4/1990 | Boeshart | 52/426 |

(Continued)

FOREIGN PATENT DOCUMENTS

DE 3242364 A1 5/1984

*Primary Examiner*—Robert Canfield
(74) *Attorney, Agent, or Firm*—Alun L. Palmer

(57) ABSTRACT

A system and method for forming concrete structures, using foam panels as forms, supported by vertical tracks with horizontal bridge pieces inserted through the forms. The bridge pieces are in the form of triangular webs with coaxial rings for supporting vertical rebars centrally between opposing forms. The coaxial rings on opposing bridge pieces key together to securely hold the vertical rebars. At the corners of the structure, corner retaining extrusions are used having fins for retaning the foam panels, and having various included angles such as 60°, 75°, 90°, 120°, 135°, 150° or 165°. Specific types of corner tie pieces for square, obtuse or acute corners are used to connect together the corner retaining extrusions at the inner and outer corners of the structure.

20 Claims, 10 Drawing Sheets

U.S. PATENT DOCUMENTS 5,065,561 A 11/1991 Mason
5,337,534 A * 8/1994 Nasca ..... 52/745.21
5,390,459 A * 2/1995 Mensen ..... 52/426
5,566,518 A * 10/1996 Martin et al. ..... 52/426
5,570,552 A 11/1996 Nehring
5,598,675 A 2/1997 Pruss
5,657,600 A 8/1997 Mensen
5,704,180 A 1/1998 Boeck
5,782,050 A * 7/1998 Boeshart ..... 52/426
5,852,907 A 12/1998 Tobin et al.
5,890,337 A 4/1999 Boeshart
5,896,714 A 4/1999 Cymbala et al.
5,922,114 A * 7/1999 Sawada ..... 106/31.29
5,937,604 A 8/1999 Bowron
5,992,114 A * 11/1999 Zelinsky et al. ..... 52/426
6,047,515 A * 4/2000 Behlen ..... 52/699
6,079,176 A * 6/2000 Westra et al. ..... 52/404.2
6,250,033 B1 6/2001 Zelinsky
6,314,694 B1 11/2001 Cooper et al.
6,321,498 B1 11/2001 Trovato
6,352,237 B1 3/2002 Severino
6,378,260 B1 4/2002 Williamson et al.
6,405,505 B1 6/2002 Alberti
6,474,033 B1 * 11/2002 Luchini et al. ..... 52/426
6,526,713 B2 3/2003 Moore, Jr.
6,536,180 B1 * 3/2003 Rosenblat et al. ..... 52/712
6,571,528 B1 * 6/2003 Crump, Jr. ..... 52/699
2002/0014048 A1 2/2002 Meendearing
2002/0017070 A1 2/2002 Batch
2002/0023401 A1 2/2002 Budge
2002/0092253 A1 7/2002 Beliveau
2002/0124508 A1 9/2002 Dunn et al.
2003/0009967 A1 1/2003 Piccone
2003/0029106 A1 2/2003 Cooper et al.
2003/0033782 A1 2/2003 Schmidt

* cited by examiner

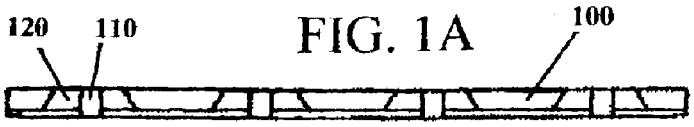
FIG. 1A
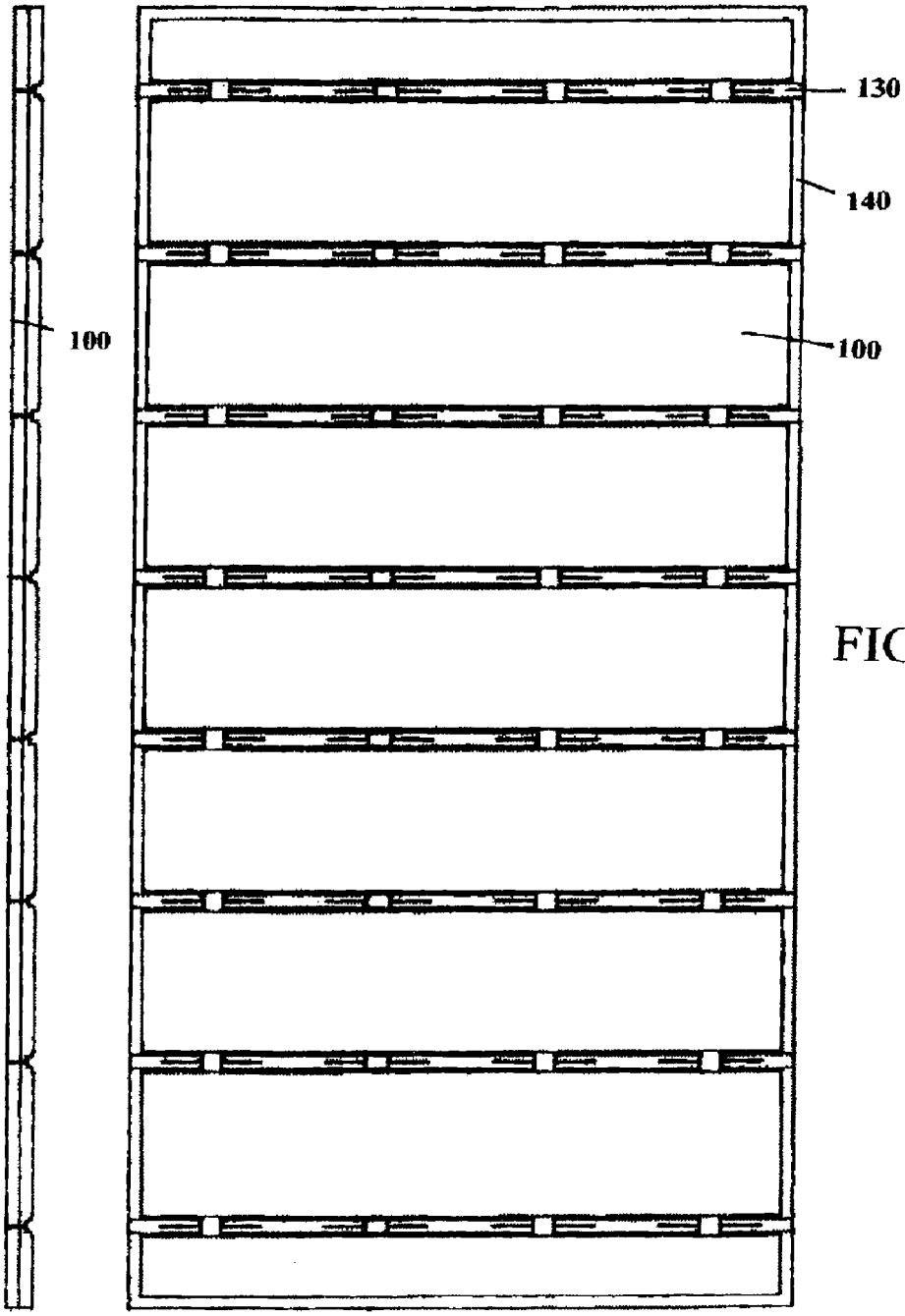
FIG. 1
FIG. 1B

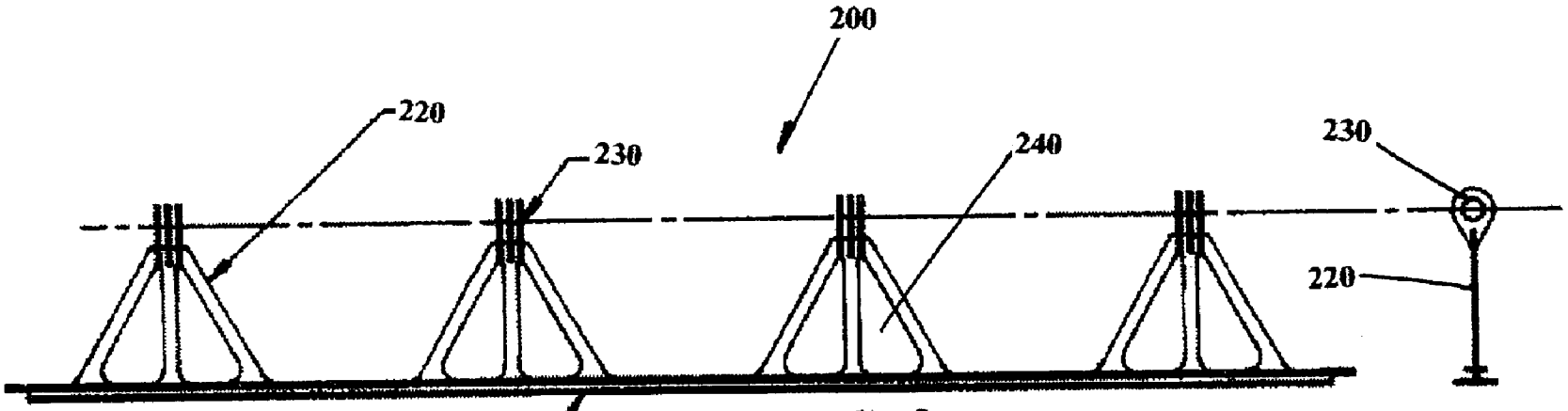
FIG. 2
FIG. 2A
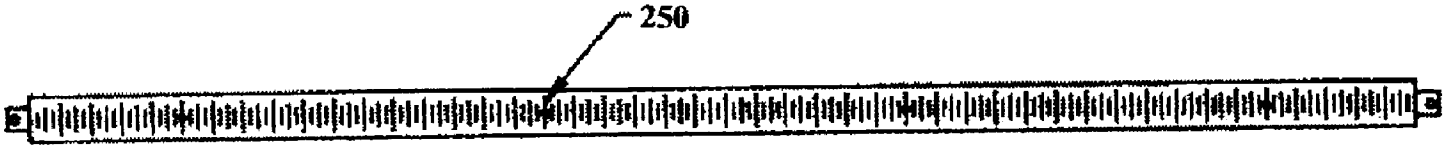
FIG. 2B 300
320
370
230
300
350
330
310
340
210
220
360
300

100
520
580
525
520
200

510
515
560
510
100
200
500
100
600
500
630
505
100
200
100

500
540
550
500
505

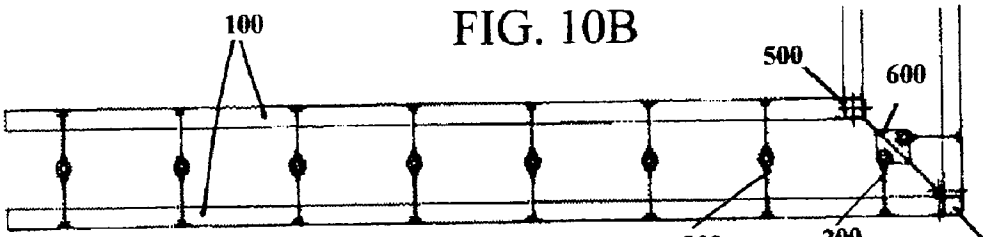
FIG. 10B
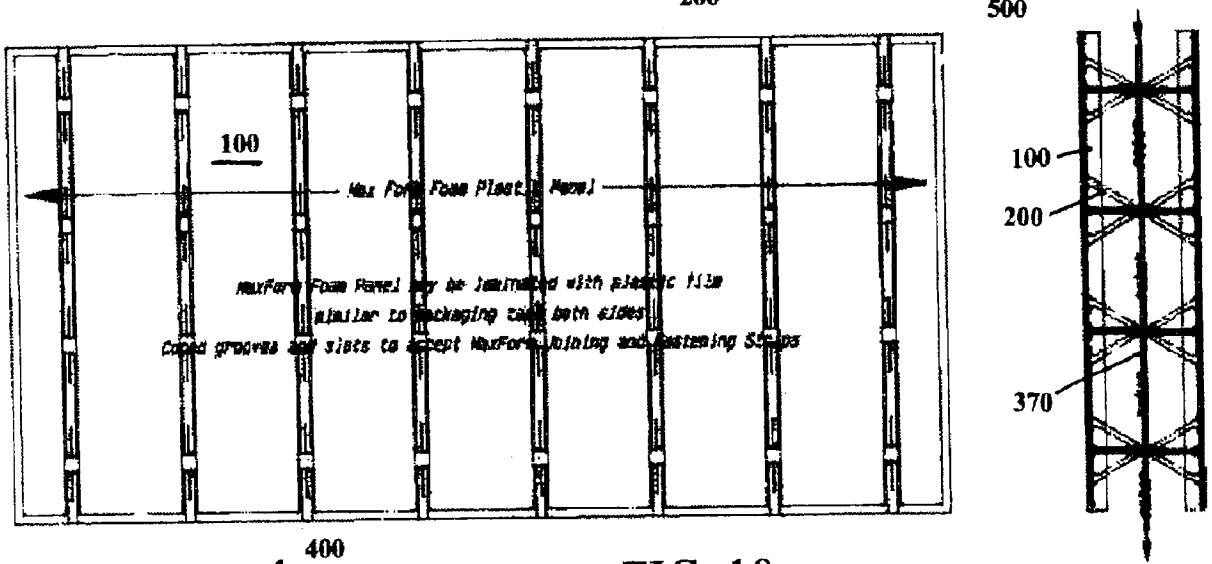
FIG. 10C
FIG. 10
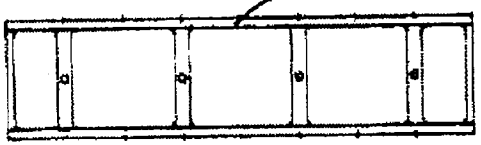
FIG. 10A

CONCRETE FORMING SYSTEM AND METHOD

FIELD OF THE INVENTION

The invention relates to a forming system for concrete structures. More particularly, the invention relates to building structures using foam panels as forms

DESCRIPTION OF THE BACKGROUND ART

Historically, concrete structure has long been used for enduring, damage resistant construction. During that history improvements have been introduced, yet there still remain drawbacks and deficiencies with conventional practice of forming concrete structures and the results obtained.

The shortcomings of conventional forming methods include waste of material, time and labor in forming and the required additional structures for attachment of "finish". Various methods to address these have been utilized but none of these methods have been as simple and standardized as the solution presented by the present invention.

The conventional form of concrete construction has not become popular or extensively used with lighter construction for smaller buildings and various lighter applications, such as small office buildings, low-rise multi-dwelling units and individual residential housing units because of aesthetic limitations imposed.

There have been many configurations of foam blocks or foam planks, which have been introduced to the construction industry to simplify the forming and construction of foam, insulated concrete structure. Each of these has addressed the problem in similar fashion with molded shapes with integral spreaders and or webs between the exterior and interior surfaces, having molded hollows and pockets into which the concrete is placed, but which impede the easy and uniform flow of concrete introduced therein. The usual configuration is a relatively small molded block form None have addressed the above problems as simply and directly as does the present invention.

A further problem with known concrete forming systems employing foam blocks, is that the light weight of the foam blocks can lead to the forms being blown over by high winds even before the concrete is poured. This is a particular problem in areas of flat terrain, where high winds occur more frequently.

These and other problems of the background art may be overcome by the present invention, as will be discussed below with regard to the drawings.

SUMMARY OF THE INVENTION

The present invention is a concrete forming system designed to eliminate the problems of conventional forming of concrete structures and to advance the state of the art of construction of composite wall structures, with emphasis beginning with the form body itself. In a preferred embodiment of the invention, plastic foam sheets, which may for example be 4'×8' in size, and separable insertable components are utilized to facilitate erection of the form structure in a minimum amount of man hours per square foot of wall formed, in a coherent form system. Assembly time for this system is approximately 1/10th or less of that of conventional methods using plywood panels and approximately 1/3rd that of other foam forming systems presently in use Additionally, the present system is designed to reduce the cost of materials required significantly providing or exceeding the advantages of stick framed construction, without most of the disadvantages.

The system advances the art of poured-in-place concrete construction. Providing a system of embedded and peripheral components, each described in the following detailed description, the system generates an inventive means of forming of concrete, providing components that serve as both form, insulation and surface elements which provide for fastening of ancillary veneers to the structure The system combines many of the appealing attributes and hallmarks of traditional stick-frame, in addition to the structural integrity, accelerated construction schedule, cost reduction, and much superior sound and thermal insulation factors. The finished structure is termite proof, fire-safe, and has the geophysical disturbance strengths provided by reinforced concrete The system components collectively provide precise and predictable construction management, project scheduling, cost control, labor and material requirements.

The inventive system improves over the background art, providing a type of forming for concrete structures which resolves existing problems, adding to the art of concrete construction greater practicality and aesthetic appeal.

The invention System broadens the scope of applications for concrete construction, providing formation methods which are adaptable to smaller buildings and lighter construction, providing benefits to both the contractor and the owner, and making possible the extensive use of the system by the "Do It Yourself" segment of the construction and building industry.

The invention resolves these problems by providing fastening elements about the peripheral and orifice edges of the concrete panels, as well as fastening elements or strips in the medial portions of the panels. These may be formed of polymeric material and accept traditional nail and screw type fasteners. The inventive system does not negate the use of conventional adhesives, and is compatible with such fastening means.

At present, when traditional nail or screw fastenings are used with conventional concrete walls, fastening elements need to be established on the surface of the concrete structure as a secondary complex operation The system of the invention solves this problem by providing elongate linear fastening areas or strips that are typically placed in parallel relationship identical to traditional stick-frame "studs in a wall" construction. To simplify location and measurement each fastening strip and element of the inventive system is preferably provided with visually exposed measurement markings to simplify construction accuracy.

An important problem with the use of conventional concrete panels in lighter construction has been in providing an economical and easy-to-use method for forming without waste of material. Forming structure has typically been formed with wooden members, which generally have wasted much material and excessive waste of labor. The elimination of this waste is inherent in the inventive system, which maximizes economies. In the past, various reusable, normally modular forming systems have been introduced. These systems have generally been quite expensive and have required substantial expertise, preventing their general acceptance. There is no necessity for additional forming elements that do not become a part of the ultimate structure and the process, and avoids the waste of discarded forming material. The simplicity and "user friendly" precision is the major attribute of the inventive system The invention, in addition to providing its benefits in general, allows use of all of the traditional auxiliary elements and processes historically associated with concrete walls in their traditional and familiar forms.

In conclusion, the value of the invention System does not reside solely in any one of these features individually. The invention is uniquely innovative in the synergistic combination of all of its features and components collectively.

BRIEF DESCRIPTION OF THE DRAWINGS

The invention will be further described in relation to the following several views, in which like numerals denote like elements:

FIGS. 1, 1A and 1B—Showing views of a typical foam forming panel according to the invention;

FIGS. 2 (side view), 2A (end view) and 2B (showing outer edge)—Typical detail of a joining and fastening strip according to the invention;

FIGS. 10, 10A, 10B and 10C—Showing views of the components of the forming structure as installed.

DETAILED DESCRIPTION

The system consists of a number of components, and each of these will be considered in turn.

Figure 7:
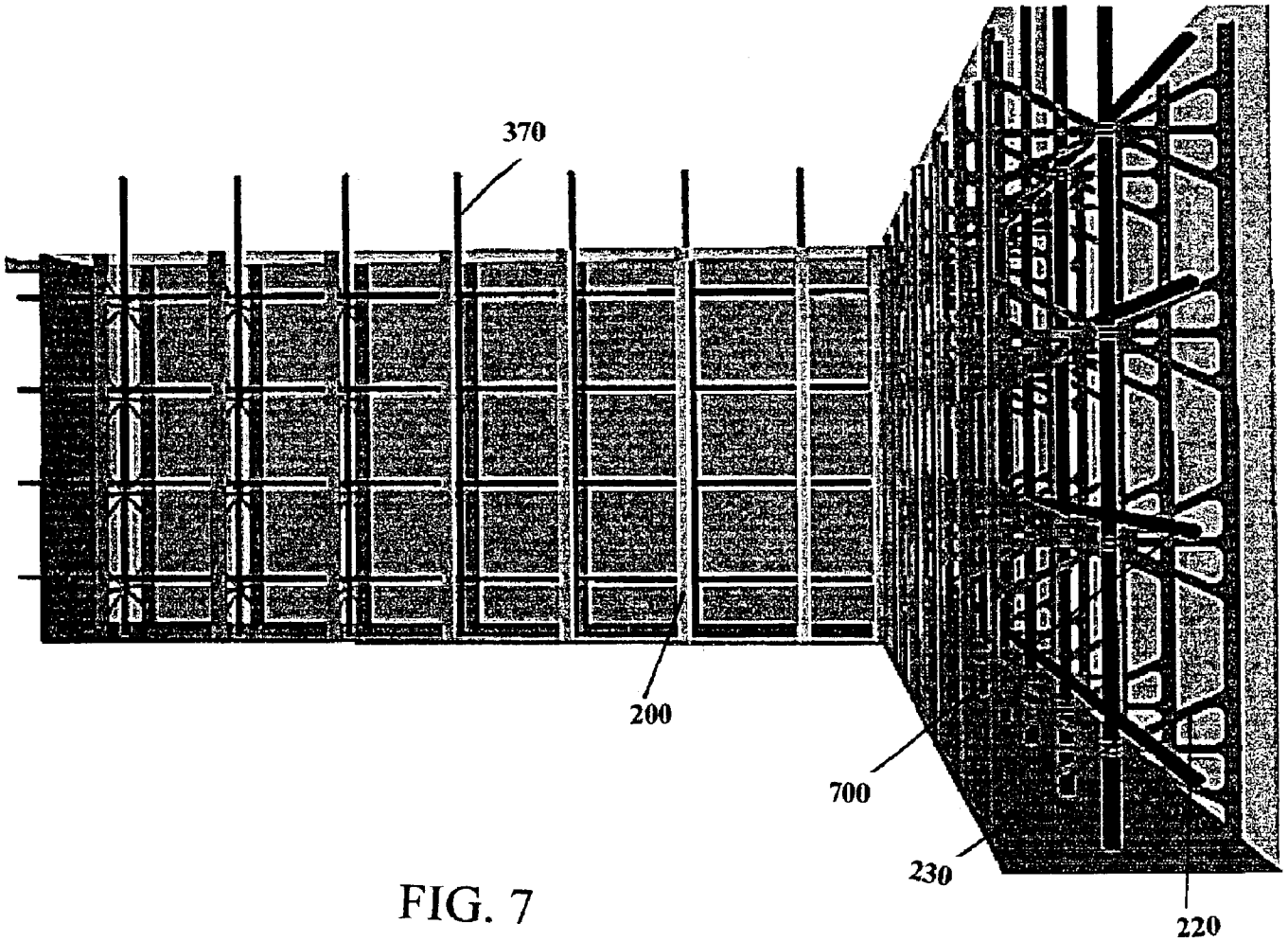
FIG. 7—Isometric view of typical forming structure.
Figure 8:
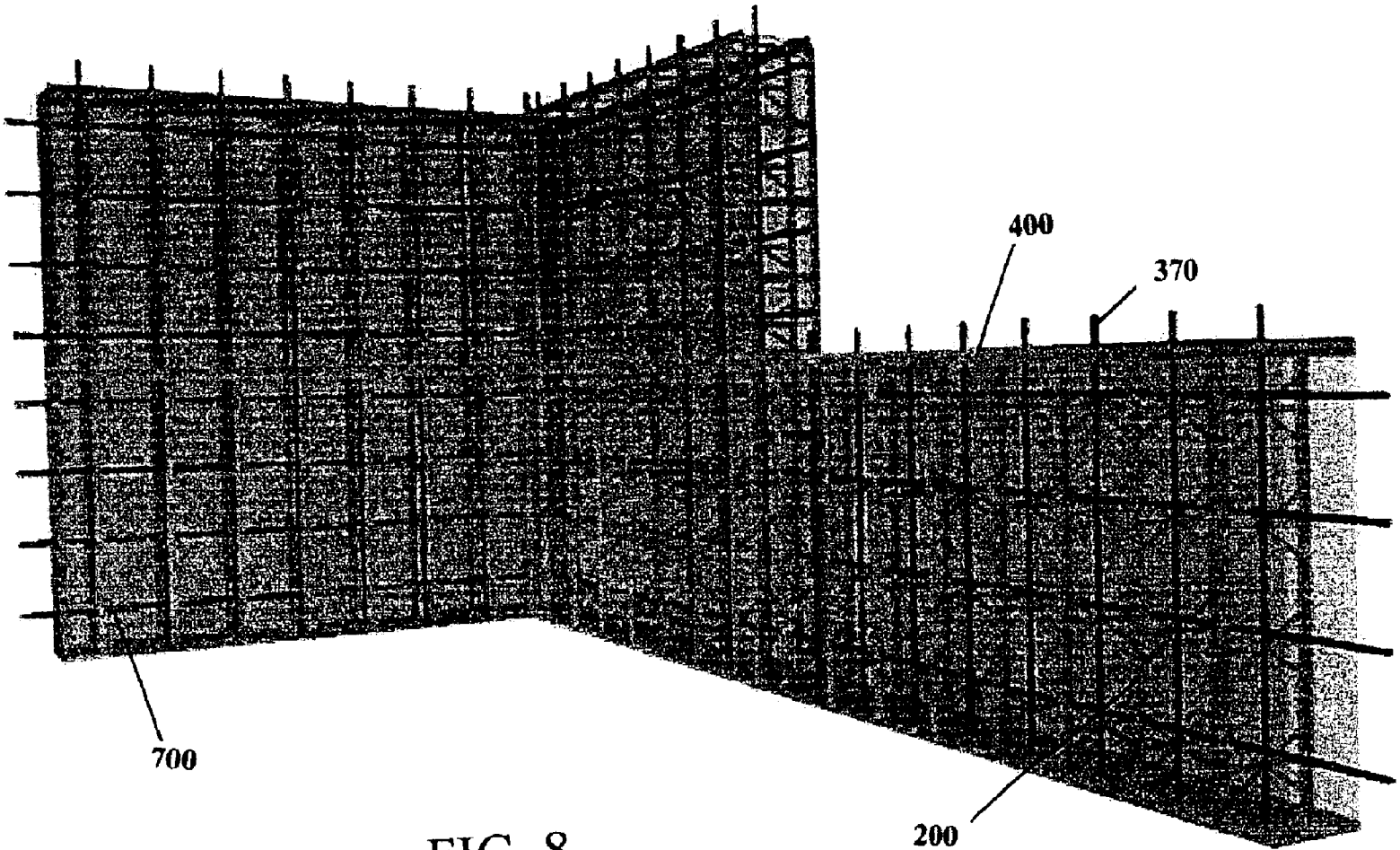
FIG. 8—Isometric view of typical forming structure showing 2nd course.
Figure 9A:
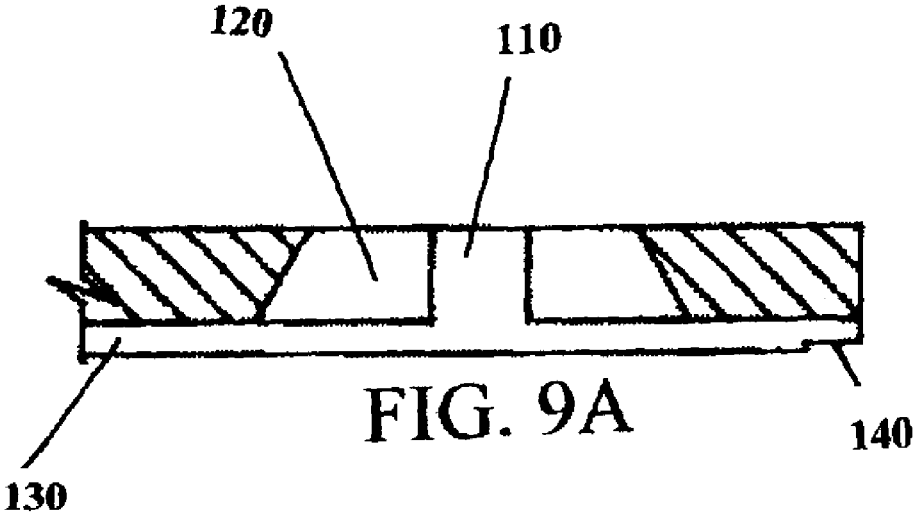
FIGS. 9 and 9A—Foam sheet showing typical coring according to the invention.
Figure 9:
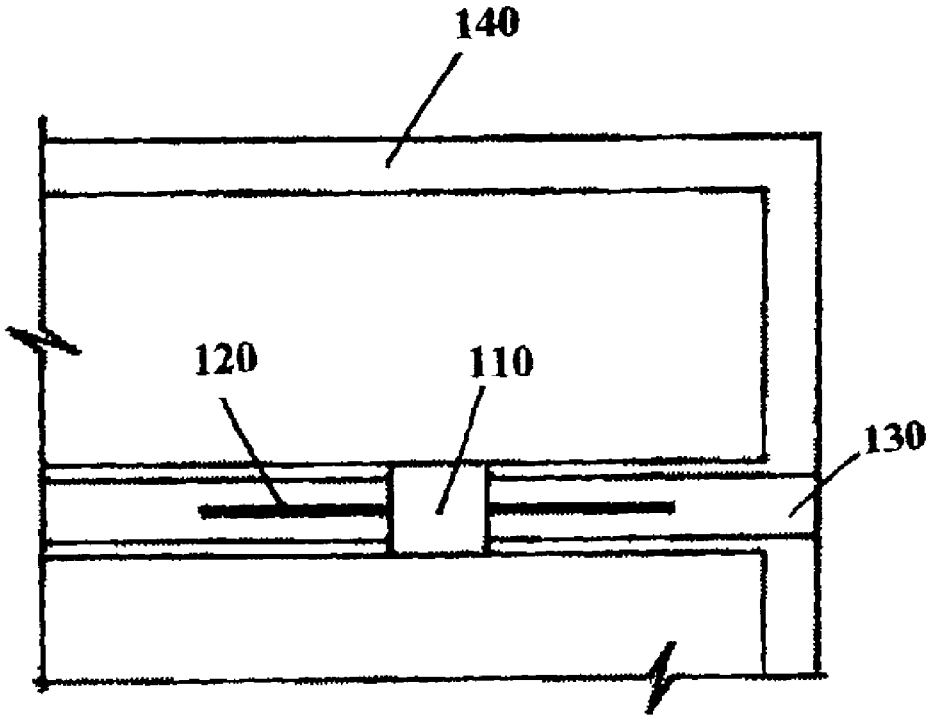

The foam forming Panel will first be considered. This typically consists of a 4×8-foot sheet of plastic foam in standard thickness, but may be of any practical dimension, and may be made from any suitable material. It has cutouts on 8 inch or 12 inch standard centers, or other centers as desired, including metric, to accept and locate the Joining and Fastening Strips of the invention. They may be installed in varying thickness, for example, a 3 inch thick panel on the exterior face, and a 2-inch thick panel on the interior face, as desired to provide the best thermal performance. See FIGS. 1, 1A and 1B. FIG. 1B shows a view of one corner of the assembled system as an example. FIGS. 7 and 8 similarly show computer generated perspective views The Joining and Fastening Strips will be considered next. These are preferably manufactured from reclaimed plastic with appropriate filler as an injection molded parts, which in use accomplishes the joining of the inner and outer form panels into a structure which can then be filled with conventional or light aggregate plastic concrete They may be molded in approximate 4 foot sections, consisting of a rail fastening member with triangular webbed extensions or bridge pieces which mate at the center of a wall structure by way of intermating coaxial rings through which a structural rebar is inserted longitudinally to key and lock the inner and outer form panels together. Unique to the invention, the mating coaxial features place and position the structural rebar reinforcement curtain precisely in the center of the concrete. See FIGS. 2, 2A and 2B. By employing multiple coaxial rings, relative vertical movement between the opposing bridge pieces is prevented, thereby improving the overall stability of the structure.

Next, we will discuss the Bottom Positioning Tracks. These may be made of a reclaimed plastic with appropriate filler injection molded or extruded section, which accomplish the placement and positioning of the forms on a footing or slab deck during setup in compliance with a design. These may be fastened in place by any conventional means. These Tracks maintain the form sections in a straight and true position for easy assembly. After the plastic concrete is placed and set, the Bottom Positioning Tracks provide a horizontal nailing fastening surface along the bottom edge of the structure for fastening of interior and or exterior veneers of any conventional type. This eliminates the installation and cost of walers, temporary stays and plates. See FIGS. 3, 3A, 3B and 3C.

The Joining Track may be a reclaimed plastic item with appropriate filler injection molded or extruded section that accomplishes a number of functions in the system. The primary function is in the horizontal and vertical joints between form panels. Placed in the joints, the Joining Track maintains joint integrity and positioning and prevents joint spring due to the hydraulic pressure of the plastic concrete. After the plastic concrete is placed and set, it provides horizontal and vertical nailing/fastening surfaces for fastening of interior and or exterior veneers of conventional type. The Joining Track may also be used around the periphery of window and door openings to precisely place and retain conventional window and door bucks. At the top of the structure, the Joining Track similarly positions and retains plates for subsequent installation of joists and/or rafter truss structures See FIGS. 4, 4A, 4B and 4C.

The Corner Fastening Extrusions may be plastic (with appropriate filler and/or forming) extruded sections which are placed in the form corners on the interior and exterior of the foam. These are manufactured to accommodate the included angle of varying degrees at a corner of form structure, most commonly 60°, 75°, 90°, 120°, 135°, 150° and 165° corners, and may be manufactured to accommodate any other corner configuration. They hold and brace the inside and outside of the form corner in a similar manner to the Joining Track. After the plastic concrete is placed and set, they provide vertical nailing/fastening surfaces for fastening of interior and/or exterior veneers of conventional type at the corners. See FIGS. 5, 5A, 5B, 5C and 5D.

The Corner Tie Pieces 600 will be discussed next. These are plastic (with appropriate filler and/or foaming) injection molded pieces that work in concert with the Corner Fastening Extrusions, providing keying and placement of rebar in the corner of structure. These may be fastened to the Corner Fastening Extrusions using conventional self-threading screws or any other means. They provide for interlocking of Joining and Fastening Strips and the foam panels 100 in the corner section. See FIGS. 6, 6A and 6B as well as 5A, 5B, 5C and 5D.

As the panels and components of the invention are placed and interlocked with sections of structural rebar, all vertical structural rebar 370 is automatically placed and maintained on exact centers. Horizontal structural iron rebar 700 may be placed above the interlocking webs of the invention Joining and Fastening Strips 200 at desired increments and comes to rest in the center of the void, rolling or sliding into contact with the verticals 370. Wire tying of the vertical and horizontal rebar is not required. The preferred configuration of the invention naturally provides correct positioning and alignment of the structural rebar curtain No secondary craft operations are required. It will, of course, be appreciated by those skilled in the art that the rebars may be made of steel or other suitable material. See FIGS. 7 and 8.

According to a preferred embodiment of the invention, the inventive foam Forming Panel 100 is a planiform structure, preferably made of semi-rigid foam, of incremental thickness, having, at standard construction centers or other centers as desired, cored through holes 110, slots 120 and part through recesses 130 spaced transversely across the width of the panel 100, and incrementally the length of the panel. The holes 110, slots 120 and part through recesses 130 are configured to accept and nest the inventive Joining and Fastening Strips. The foam Forming Panel 100 is recessed on the exterior face around the entire periphery to accept and nest one flange of the Bottom Positioning Track 300 and/or the Joining Track 400. Similarly, around the edge periphery of panel 100 is a groove 140 for nesting the medial indexing flanges of the Bottom Positioning Track 300 and/or the Joining Track 400. This groove 140 in the interior and exterior Form Panels 100, nesting with the medial indexing flanges, locks and maintains the spread between the opposing Forming Panels 100. See FIGS. 1, 1A, 1B, 9A and 9B Referring now to FIGS. 2, 2A and 2B, the Joining and Fastening Strips 200 are made up of a longitudinal spine 210 having at standard increments, typically four in the longitudinal length of the spine 210, a webbed triangular section or bridge piece 220 extending from an interior surface of the spine 210 a distance as defined by the center of a desired design structure. It will be appreciated by those skilled in the art that each webbed triangular section or bridge piece 220 may either be integral with the spine 210 or may be a separate part. At the inner end of the triangular web 220 are intermating coaxial rings 230, the center axis of which is arranged parallel to a longitudinal axis of the spine 210. The rings 230 are so disposed that another identical Joining and Fastening Strip 200 installed in opposition to the first said strip mates intimately. The two are keyed together, thereby providing locking of the structure, by insertion of a section of structural rebar steel (not shown) longitudinally through the sockets thereby formed by the intermating coaxial rings 230 of the opposing Joining and Fastening Strips 200. In use the Joining and Fastening Strips 200 are inserted individually through the holes 110, slots 120 and nesting recesses 130 heretofore described of foam Forming Panels 100, the panels 100 defining the side walls of the structural form at the time of the initial erection of the form. The Joining and Fastening Strips 200 are of a specified dimension from the spine 210 to the center of coaxial rings 230 for each thickness of the foam Forming Panel 100 being used. The triangular webs 220 have cutouts 240 through which conduit and plumbing (not shown) may be horizontally inserted and thereby accurately maintained in known position, either in the center of the concrete or at the surface of the concrete. Embossed or printed measurement markings 250 are also included on the outer side of flanged spline 210, as can be seen in FIG. 2B.

Figures 3, 3A, 3B, 3C:
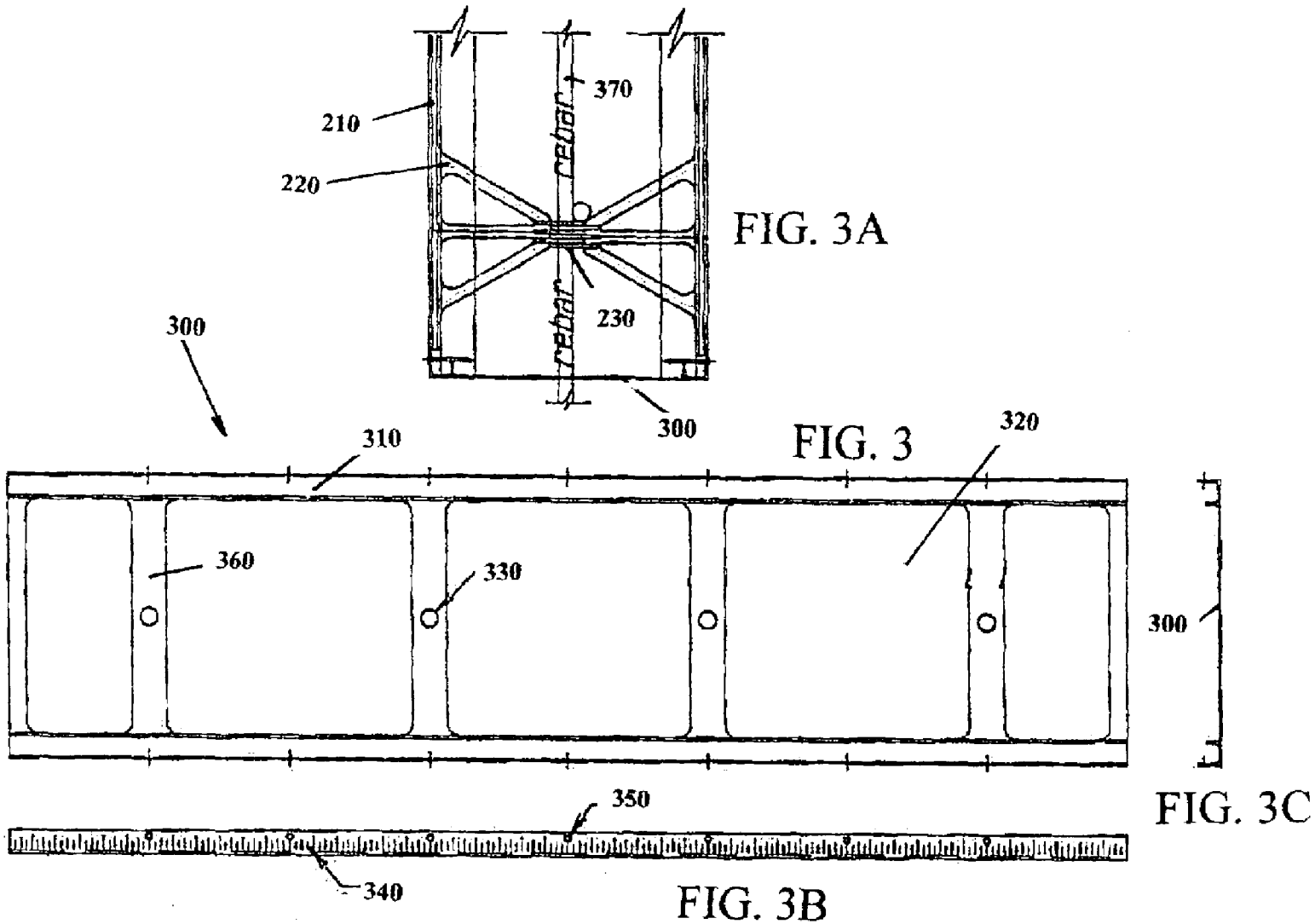
FIGS. 3, 3A, 3B and 3C—Bottom positioning track according to the invention.

Referring to FIG. 3, the Bottom Positioning Track 300 is preferably a longitudinal plastic channel of indefinite length, of width defined by the finished wall thickness, as required to match an intended design layout of the peripheral walls and interior walls of the finished structure. This channel may have continuous edge and medial flanges 310 and regularly repeated cutouts 320 in the web portion 360 of the channel. The edge flanges 310 may be pierced with holes 340 at regular intervals for the insertion of common nails or other suitable fasteners (not shown), to provide for intimate keying and locking of the foam Forming Panels 100 in place as desired The repeated cutouts 320 are preferably at standard intervals in the web portion of the channel and are preferably so configured to provide bonding area to fittings or slab and through holes 330 for tie bolts or rebar pins (not shown). Bottom Positioning Track 300 may also be fastened to footings or a slab (not shown) through the remaining web 360 by use of any other common fasteners, i.e. hardened nails or expansive means, etc. The purpose of the Bottom Positioning Track 300 is to locate positively the form to a layout, and to prevent bursting or spreading deformation due to the hydraulic pressures imposed by the placement of plastic concrete within the finished form. The position of Bottom Positioning Track 300 is shown relative to other components including rebar 370 in FIG. 3A. Edge flanges 310 also carry embossed or printed measurement markings 350, as shown in FIG. 3B.

Figures 4, 4A, 4B, 4C:
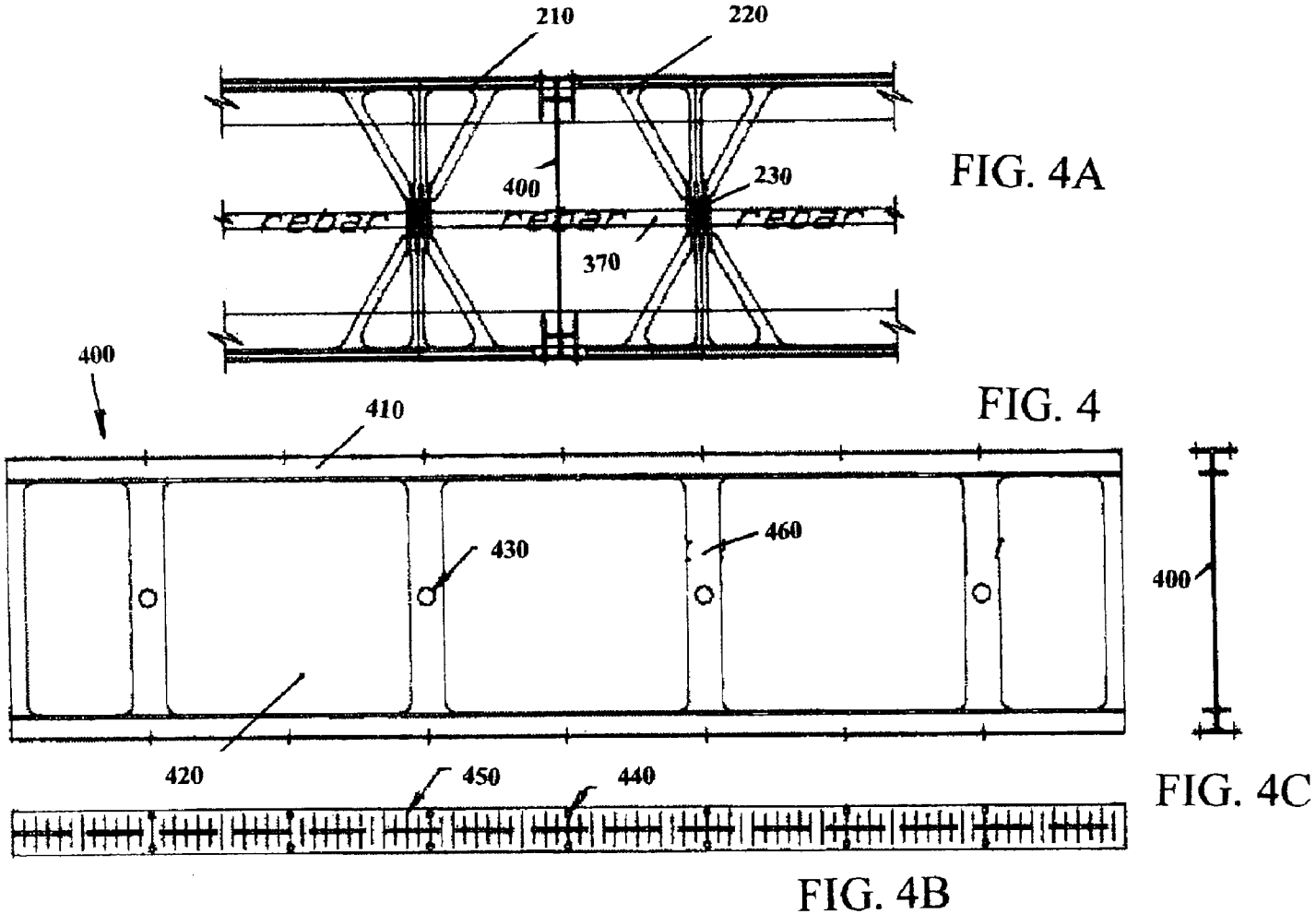
FIGS. 4, 4A, 4B and 4C—Joining track according to the invention.

Referring to FIG. 4, the Joining Track 400 of the invention is preferably a longitudinal plastic "I" bean of indefinite length, of width defined by the finished wall thickness, in essence identical to Bottom Positioning Track 300 except having edge and medial flanges 410 extending from both surfaces of the joining web 460. All features are preferably located on identical centers as with Bottom Positioning Track 300. In use the Joining Track 400 may be placed at the interstitial joints of the foam Forming Panels 100, providing retention at the joints to prevent spreading of the joints due to hydraulic pressures imposed by the placement of the plastic concrete within the form. Joining Tracks 400 may be keyed and locked as desired to the foam Forming Panels 100 by insertion of common nails or any other suitable fasteners (not shown) through the holes 440 provided in the flanges 410, similarly to Bottom Positioning Track 300. Joining tracks 400 are also provided with holes 430 for rebars or the like, and are provided with cutouts 420. The position of Joining Track 400 is shown relative to other components in FIG. 4A. Edge flanges 410 also carry embossed or printed measurement markings 450, as shown in FIG. 4B.

Figures 5, 5A, 5B, 5C, 5D:
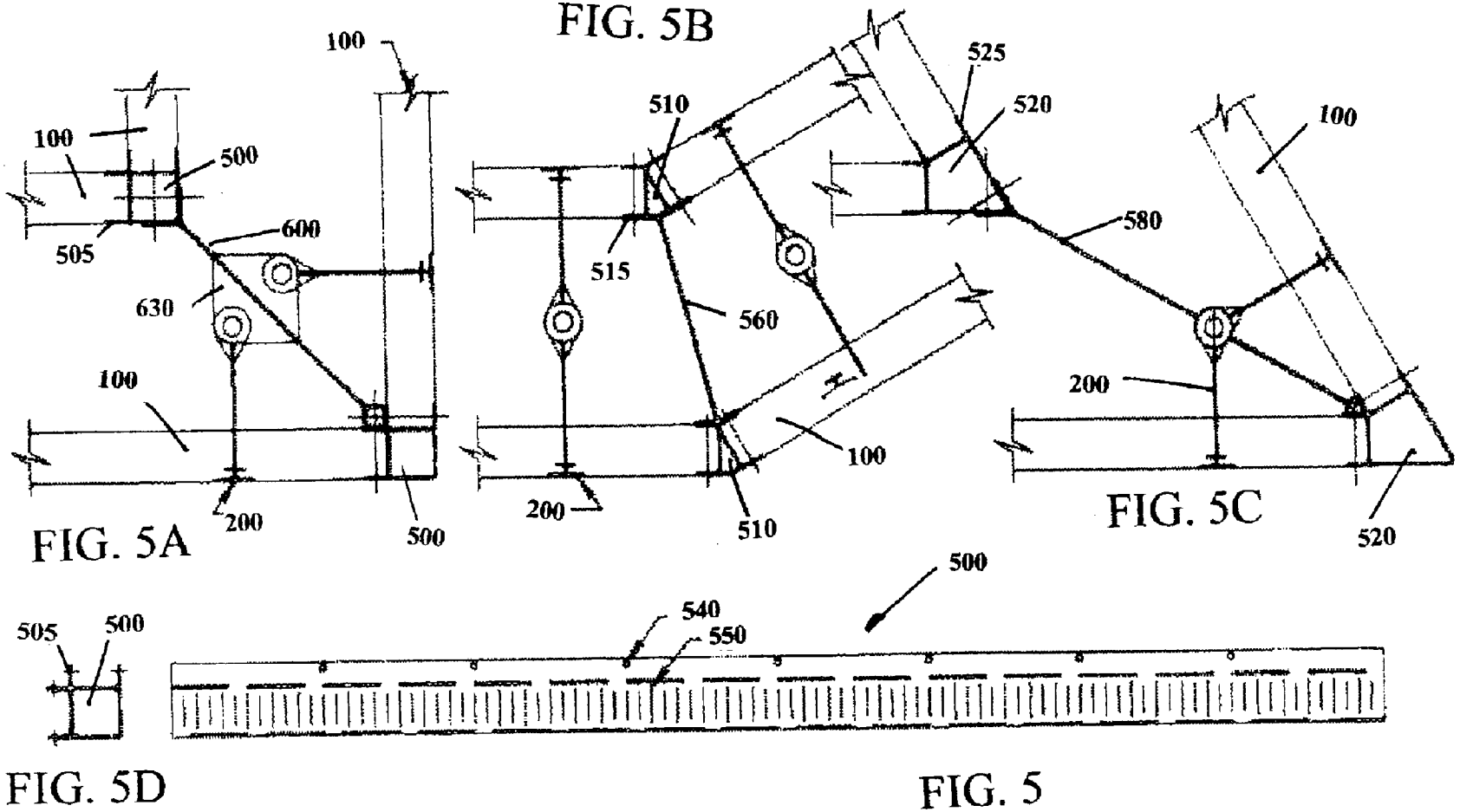
FIGS. 5 and 5D—Corner fastening extrusion according to the invention.
FIG. 5A—Square corner configuration.
FIG. 5B—Obtuse corner configuration.
FIG. 5C—Acute corner configuration.

Referring to FIG. 5A, which shows a square corner configuration, the Square Corner Fastening Extrusion 500 is preferably a closed box section of indefinite length having continuous fins 505 extending from the closed box section of such shape as to support and hold the foam Forming Panels 100 at square corner Intersections. This closed box section is of specific dimensions for each thickness of Foam Forming Panel 100 being used. In this square corner configuration, joining strips 200 are connected to flanges 630 on corner tie pieces 600. FIG. 5 shows fastener holes 540 and measurement markings 550 on Square Corner Fastening Extrusion 500.

Various corner angles other than a right angle may also be obtained, as discussed above. FIG. 5B shows an obtuse corner configuration, employing Obtuse Corner Fastening Extrusions 510 having continuous fins 515, shows a tie piece 560 and shows joining strips 200 connecting directly together instead of to Corner Tie Piece 600. FIG. 5C, on the other hand, shows an acute corner configuration, employing Acute Corner Fastening Extrusions 520 having fins 525, shows a tie piece 580 and shows joining strips 200 connecting together at the center of tie piece 580.

Figure 6:
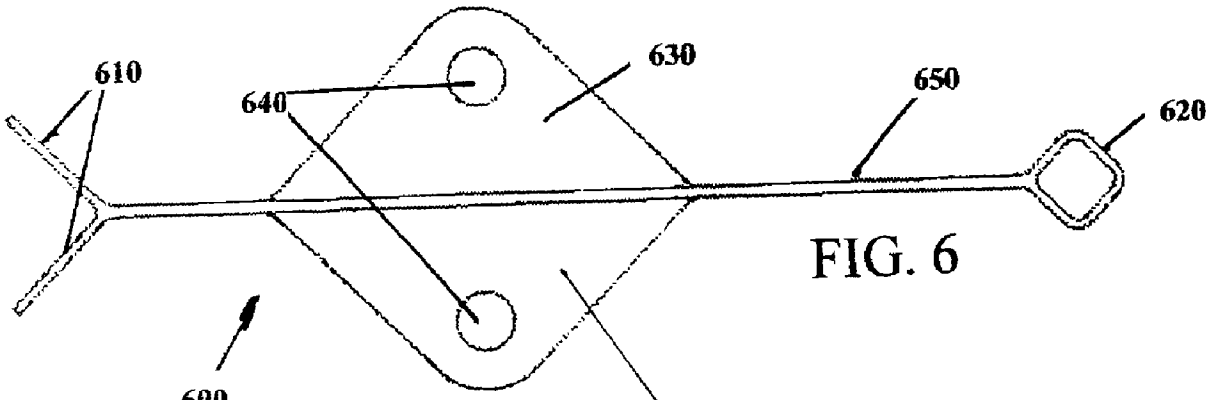
FIGS. 6, 6A and 6B—Corner tie—square corner configuration.
Figure 6B:
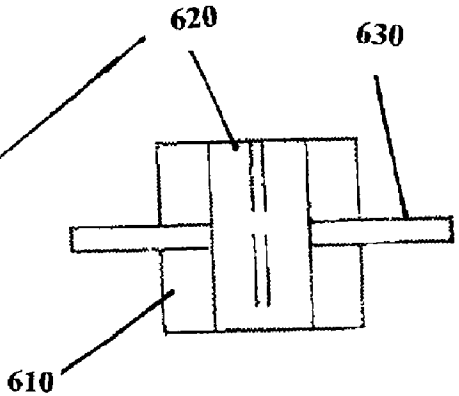
Figure 6A:
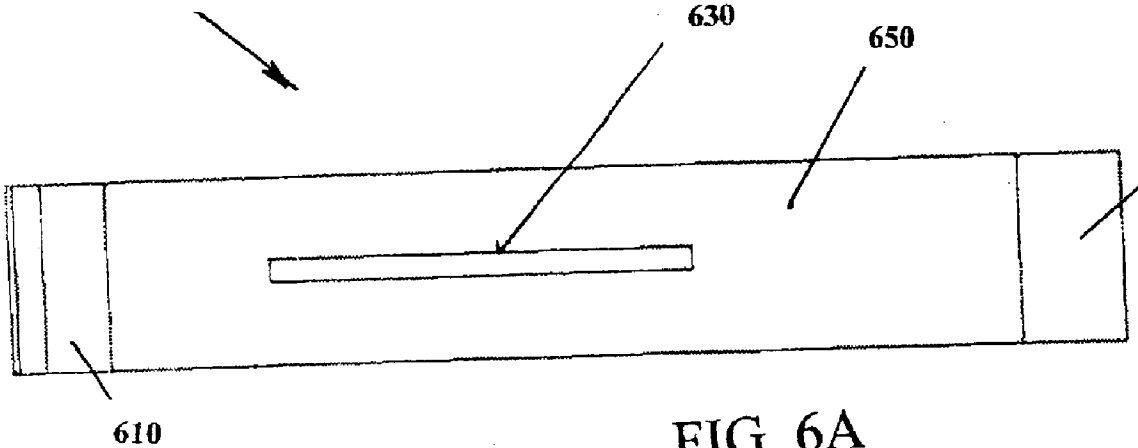

The Square Corner Tiepiece 600 is shown in more detail in FIGS. 6, 6A and 6B, and is a strap form tie between the inner and outer Square Corner Fastening Extrusions 500, having mating flanges 610 on the interior end connected via strap 650 to a box form 620 at the exterior end for fastening with self-threading screws (not shown) to the corner extrusions 500. Midway between the inner and outer ends of the tie 600 are opposing flanges 630 having holes 640 for mating with the Intermating coaxial rings 230 of the Joining and Fastening Strips 200. The inventive forming structure is thereby keyed together at the corners and locked by insertion of a section of structural rebar steel longitudinally through the sockets thereby formed by the intermating coaxial rings 230 and opposing flanges 630 of the Corner Tiepiece 600.

The invention provides benefits in all major construction phases, as will be discussed below.

The benefits and advantages of the invention may be visualized more easily in the light of the following discussion. These benefits most importantly translate into the maximum job productivity and economy. The inventive system requires only approximately ½ the cost of material and approximately ⅓ the cost of labor of the systems of the background art.

The above-mentioned benefits and advantages occur in at least the following areas:

Shipping

Safety

Learning curve

Ease of Handling and Erection time

Versatility

Uniformity

Structural and Insulation values, environmentally sound

Expense

Speed

First, Shipping. Typical foam systems in practice today ship a large volume of air, i.e., the molded hollows and pockets within the individual block forms. The forms of the invention are shipped in sheet form as solid products without hollows or pockets. For example, the shipping cost of form products for a 12,000 square foot structure, using other presently available foam forming systems, would be that required for approximately 3½ truckloads. One truckload of the forms according to the preferred embodiment of the invention accomplishes the same for approximately ⅓ the cost. The materials in their compact form occupy ⅓ the volume of other products in the background art to accomplish a finished structure of the same or similar dimensions.

Second, Safety, an issue common to all construction programs. The inventive foam forming panel is very light weight, negating back injuries, cuts, contusions, splinters, mashing, etc.

Third, the learning curve for the forming system of the invention is straightforward and is not compounded by the various directives or designs called for by engineering, architects, crafts, etc., and allows even non-professionals to handle their own construction The concept of the system is simple and user friendly that the process of erection is grasped immediately.

Fourth, typical erection time for wall forming of the invention is approximately 30 minutes per 100 square feet of wall surface. The elements of the system interlock and key together providing a stable form with ease. The lighter weight of all the components compared with the background makes handling easier and simpler. No special equipment or tools are required, most assembly being done with NO tools. When tools are required, these are ordinary common tools.

Fifth, The invention is very versatile. The invention is not limited to any fixed foam body thickness, for example, the system can readily use 2", 3", 4", etc. thickness plastic foam in any combination, interior or exterior, in accordance with the design and environment needs as required. This is a benefit heretofore not available in the background art. Architectural and aesthetic requirements are easily configured. Conventional accessories such as window and doorframes, etc. are accommodated much more easily than with conventional forming methods. The invention is not limited in the accomplishment of architectural structures.

Sixth, Uniformity. The assemblage of components fix the form to standard uniform dimensions throughout the structure, placing all structural rebar on both horizontal and vertical centers automatically, and maintaining the concrete structure thickness finitely. The Joining Tracks and Fastening Strips are automatically placed with precision on standard construction centers for ease of fastening of all ancillary veneers and trade equipment items The plastic foam panels provide totally uniform building insulation, with no deviation except as designed and predicated by engineering. The placement of the webs of the invention Joining Tracks and Fastening Strips automatically position trade items such as conduit, plumbing, etc, within the wall at the inner or outer surface of the concrete as desired, and at the proper elevation from grade. Rough-in of conduit, electrical junction boxes, plumbing, etc., can be accomplished before any placement of concrete.

Seventh, Structural and Insulation values, and Environmentally soundness. The uniformity already noted yields design stress levels without deviation, and a structure highly resistant to geophysical damage. It provides uniform insulation thickness. The insulation coupled with the concrete structure typically provides a finished structure with energy saving thermal mass and thermal resistance value of R 40–50, or more if so designed. The invention, in allowing interior and exterior variation of the plastic foam thickness, provides the most advantageous and environmentally sound thermal performance for any given climatic situation and location. All components of the system are vermin and rot proof, as they can be made from virgin or recycled and reclaimed plastic materials, which is therefore naturally environmentally responsible, with no wastage of wood and other environmentally sensitive materials as occurs with conventional forming methods. Attenuation of noise from external sources is superb, achieving a sound transmission classification of 50 or higher. External noise is inaudible.

Eighth, Expense. All of the above provide a system which yields least cost for the finished product, a structure to be proud of, addressing both cost of materials end cost of labor. At the time of writing, the typical cost of materials would be approximately $1.50 per sq. ft. vs. approximately $3.00 per sq. ft. of formed wall area for systems of the background art. No specialized labor is required, and assembly time is approximately one third that of any background art system.

Ninth, Speed. On completion of assembly of the invention system, the plastic concrete is placed within the void thereby formed. Allowing the plastic concrete to set, the wall structure is immediately ready for fastening of exterior and interior finish veneers, for example, siding and sheetrock. No additional insulation or furring, or additional fastening substrates are required The ancillary veneers may be fastened by conventional means directly to the invention embedded elements on standard construction centers.

It will be appreciated by those skilled in the art that numerous modifications and variations are possible, and that the invention may be practiced otherwise than as specifically described herein, without departing from the scope thereof.

What is claimed is:

1. A bridge piece for a concrete forming system, said bridge piece comprising:

an outer end configured to mate with a substantially vertical form; and an inner end connected to said outer end, said inner end provided with a plurality of coaxial rings, said rings configured to receive a substantially vertical rebar; said rings configured to intermate with a like bridge piece; and a substantially triangular web intermediate said outer end and said inner end.

2. The bridge piece according to claim 1, wherein:

said bridge piece is made of a plastic material configured to accept fastening elements, so as to attach finish items to exterior and interior surfaces of a structure.

3. The bridge piece according to claim 1, further comprising: a web intermediate said outer end and said inner end and comprising a substantially triangular opening therein.

4. A system for forming a substantially vertical planar structure, said system comprising:

at least two opposing substantially vertical forms provided with apertures therein, said forms forming a space therebetween for receiving pourable structural material;

at least one bridge piece configured to be inserted through at least one of said apertures in each of said forms, said at least one bridge piece comprising an inner end configured to retain a substantially vertical rebar; and said inner end of said each of said bridge pieces comprising a plurality of coaxial rings configured to intermate with a like bridge piece.

5. The system according to claim 4, wherein:

said forms are made of a foamed material.

6. The system according to claim 4, further comprising:

substantially vertical tracks configured to support said bridge pieces and said forms.

7. The system according to claim 6, wherein:

said tracks are configured to accept fasteners to attach finish items to the structure.

8. The system according to claim 6, wherein:

said vertical tracks further comprise markings corresponding to units of linear measurement.

9. The system according to claim 4, further comprising:

corner retaining extrusions configured to retain said forms, and configured to accommodate a predetermined included angle between said forms.

10. The system according to claim 9, wherein:

said predetermined included angle is selected from the group consisting of 60°, 75°, 90°, 120°, 135°, 150° and 165°.

11. The system according to claim 9, wherein:

said corner retaining extrusions are configured to accept fasteners to attach finish items.

12. The system according to claim 9, further comprising:

at least one corner tie piece, comprising a substantially rigid strap configured to mate with an outside corner of a first said corner retaining extrusion and with an inside corner of a second said corner retaining extrusion.

13. The system according to claim 12, wherein:

said at least one corner tie piece comprises:

an interior end having interior mating flanges configured to mate with an outside corner of a first said corner retaining extrusion;

an exterior end having a box configured to mate with an inside corner of a second said corner retaining extrusion; and means configured to mate with said bridge pieces and with said substantially vertical rebar.

14. A system for forming a substantially vertical planar structure, said system comprising:

at least two opposing substantially vertical forms provided with apertures therein, said forms forming a space therebetween for receiving pourable structural material;

at least one bridge piece configured to be inserted through at least one of said apertures in each of said forms, said at least one bridge piece comprising an inner end configured to retain a substantially vertical rebar;

corner retaining extrusions configured to retain said forms, and configured to accommodate a predetermined included angle between said forms; and at least one corner tie piece, comprising a substantially rigid strap configured to mate with an outside corner of a first said corner retaining extrusion and with an inside corner of a second said corner retaining extrusion.

15. The system according to claim 14, wherein:

said at least one corner tie piece comprises:

an interior end having interior mating flanges configured to mate with an outside corner of a first said corner retaining extrusion;

an exterior end having a box configured to mate with an inside corner of a second said corner retaining extrusion; and means configured to mate with said bridge pieces and with said substantially vertical rebar.

16. A method for forming structures from pourable structural material, said method comprising the steps of:

erecting at least two opposing substantially vertical forms provided with apertures therein, said forms forming a space therebetween;

inserting at least one bridge piece through at least one of said apertures in each of said forms;

introducing a substantially vertical rebar through an inner end of said at least one bridge piece; and pouring said structural material into said space; wherein said inner end of said each of said bridge pieces comprises a plurality of coaxial rings configured to intermate with a like bridge piece.

17. The method according to claim 16, wherein:

said forms are made of a foamed material.

18. The method according to claim 16, further comprising the step of:

providing substantially vertical tracks configured to support said bridge pieces and said forms.

19. The method according to claim 18, further comprising the step of:

fastening finish items to said tracks.

20. The method according to claim 18, wherein:

said vertical tracks further comprise markings corresponding to units of linear measurement.

* * * * *